US008870105B2

(12) United States Patent
Gunnarsson et al.

(10) Patent No.: US 8,870,105 B2
(45) Date of Patent: Oct. 28, 2014

(54) CONE CRUSHER AND METHOD OF PREPARING CONE CRUSHER FOR OPERATION

(75) Inventors: Johan Gunnarsson, Sovde (SE); Konstantin Belotserkovskiy, Malmo (SE)

(73) Assignee: Sandvik Mining and Construction Oy, Tampere, FL (US)

( * ) Notice: Subject to any disclaimer, the term of this patent is extended or adjusted under 35 U.S.C. 154(b) by 0 days.

(21) Appl. No.: 14/236,537

(22) PCT Filed: Jun. 29, 2012

(86) PCT No.: PCT/EP2012/062654
§ 371 (c)(1),
(2), (4) Date: Jan. 31, 2014

(87) PCT Pub. No.: WO2013/017347
PCT Pub. Date: Feb. 7, 2013

(65) Prior Publication Data

US 2014/0175199 A1 Jun. 26, 2014

(30) Foreign Application Priority Data

Aug. 1, 2011 (EP) ..... 11176106

(51) Int. Cl.
*B02C 2/00* (2006.01)
*B02C 2/04* (2006.01)

(52) U.S. Cl.
CPC ..... *B02C 2/045* (2013.01)
USPC ..... 241/30; 241/207; 241/286

(58) Field of Classification Search
USPC ..... 241/30, 207–216, 286
See application file for complete search history.

(56) References Cited

U.S. PATENT DOCUMENTS 5,971,306 A 10/1999 Alford et al.
7,832,669 B2 * 11/2010 Vendelin ..... 241/207

FOREIGN PATENT DOCUMENTS

FR 2700786 A1 7/1994
JP 2001017875 1/2001
JP 2001017875 A 1/2001

* cited by examiner

*Primary Examiner* — Mark Rosenbaum
(74) *Attorney, Agent, or Firm* — Corinne R. Gorski

(57) ABSTRACT

A cone crusher has an outer crushing shell and an inner crushing shell with a crushing gap formed therebetween. The outer crushing shell is supported on an upper frame member in threaded engagement with a lower frame member. The threaded engagement is configured for adjusting the vertical position of the outer crushing shell relative to the lower frame member so as to permit adjustment of the width of the crushing gap. The upper frame member is provided with a circumferential gear ring for turning the upper frame member in the threaded engagement. The gear ring is connected to the upper frame member in a rotationally locked and vertically slidable manner The cone crusher includes a clamping arrangement for vertically clamping the gear ring between an upper clamping member and a lower clamping member.

12 Claims, 4 Drawing Sheets

CONE CRUSHER AND METHOD OF PREPARING CONE CRUSHER FOR OPERATION

RELATED APPLICATION DATA

This application is a §371 National Stage Application of PCT International Application No. PCT/EP2012/062654 filed Jun.29, 2012, claiming priority of EP Application No. 11176106, filed Aug.1, 2011.

FIELD OF THE INVENTION

The present invention relates to a cone crusher, and to a method of preparing a cone crusher for operation.

BACKGROUND OF THE INVENTION

A cone crusher may be utilized for efficient crushing of material, such as stone, ore etc., into smaller sizes. SE 1050954 A1 describes an exemplary cone crusher. In such a cone crusher, material is crushed between an outer crushing shell, which is mounted in a frame, and an inner crushing shell, which is mounted on a crushing head, by gyrating the crushing head such that it rolls on the outer crushing shell via the material to be crushed.

The crusher of SE 1050954 is provided with a gear ring for adjusting the crushing gap between the inner and outer crushing shells. The gear ring is exposed to wear, and may occasionally need replacing.

SUMMARY OF THE INVENTION

It is an object of the present invention to solve, or at least mitigate, parts or all of the above mentioned problems. To this end, there is provided a cone crusher comprising an outer crushing shell and an inner crushing shell forming between them a crushing gap, the outer crushing shell being supported on an upper frame member in threaded engagement with a lower frame member, said threaded engagement being configured for adjusting the vertical position of the outer crushing shell relative to the lower frame member so as to permit adjustment of the width of the crushing gap, the upper frame member being provided with a circumferential gear ring for turning the upper frame member in said threaded engagement, the gear ring being connected to the upper frame member in a rotationally locked and vertically slidable manner, the crusher comprising a clamping arrangement for vertically clamping the gear ring between an upper clamping member and lower clamping member. Such a clamping arrangement extends the lifetime of the gear ring, since any vibrations of the crusher will not induce excessive wear to the gear ring at the interfaces between the gear ring and other parts such as the upper frame member or any pinion in mesh with the gear ring.

According to an embodiment, the clamping arrangement comprises a power actuator for tightening the clamping arrangement, said power actuator being controlled by a control system of the crusher. Thereby, a substantial clamping force may conveniently be applied at the command of an operator, or even automatically.

According to an embodiment, said power actuator is a hydraulic cylinder.

According to an embodiment, said hydraulic cylinder is connected to a hydraulic circuit configured to operate also a set of hydraulic cylinders for clamping the threaded engagement. Thereby, the hydraulic actuator may be co-actuated simultaneously with the thread clamping cylinders, such that the clamping of the gear ring will require no additional manoeuvre of an operator or separate logic of a control system. This allows keeping the total cost of manufacturing and operating the crusher at a minimum, and reduces the risk of mistakes when preparing the crusher for operation.

According to an embodiment, said upper and lower clamping members are fitted to the lower frame member.

According to an embodiment, the lower clamping member is fixed to the lower frame member, and the upper clamping member is moveable relative to the lower frame member. Thereby, the gear ring may slide upon the lower clamping member when turning, reducing the need for any other arrangements for keeping the gear ring vertically aligned with e.g. a pinion for turning the gear ring According to an embodiment, the lower clamping member is formed by a motor support bracket. Such an embodiment saves weight of the crusher, since no separate structure is needed for forming the lower clamping member.

According to an embodiment, the clamping arrangement comprises a pair of upper clamping members flanking a lower clamping member along the circumference of the gear ring.

According to an embodiment, at least one of said clamping members comprises a clamping pad of synthetic or natural rubber. The friction between such clamping pad(s) and the gear ring improves the holding of the gear ring.

According to another aspect of the invention, parts or all of the above mentioned problems are solved, or at least mitigated, by a method of preparing a cone crusher for operation after having adjusted a crushing gap between an outer crushing shell and an inner crushing shell, the method comprising vertically clamping a crushing gap adjustment gear ring. Such a method extends the lifetime of the gear ring, since any vibrations of the crusher will not induce excessive wear to the gear ring at the interfaces between the gear ring and other parts of the crusher.

According to an embodiment, the method comprises simultaneously clamping said crushing gap adjustment gear ring and a crushing gap adjustment thread. Thereby, the clamping of the gear ring will require no additional decision of an operator or separate logic of a control system. This allows keeping the total cost of manufacturing and operating the crusher at a minimum, and reduces the risk of making mistakes when preparing the crusher for operation According to an embodiment, said crushing gap adjustment gear ring and said crushing gap adjustment thread are simultaneously clamped, by means of respective clamping arrangements, by operating a hydraulic circuit common to said clamping arrangements. This saves additional crusher weight and cost of manufacture, since a single hydraulic circuit is given two functions.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF THE EXEMPLARY EMBODIMENTS

Figure 1:
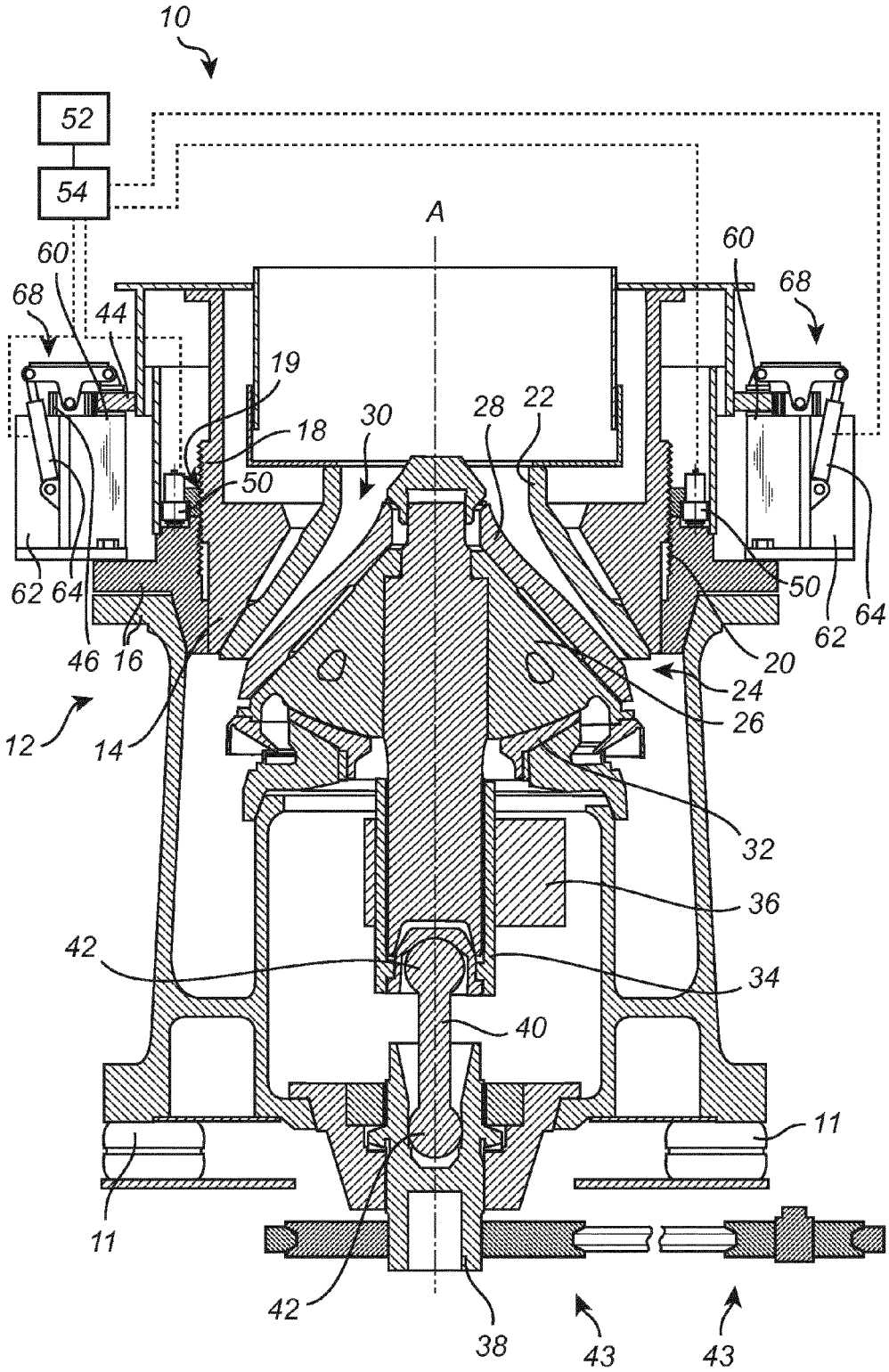
FIG. 1 is a diagrammatic view in section of a cone crusher.
Figure 2A:
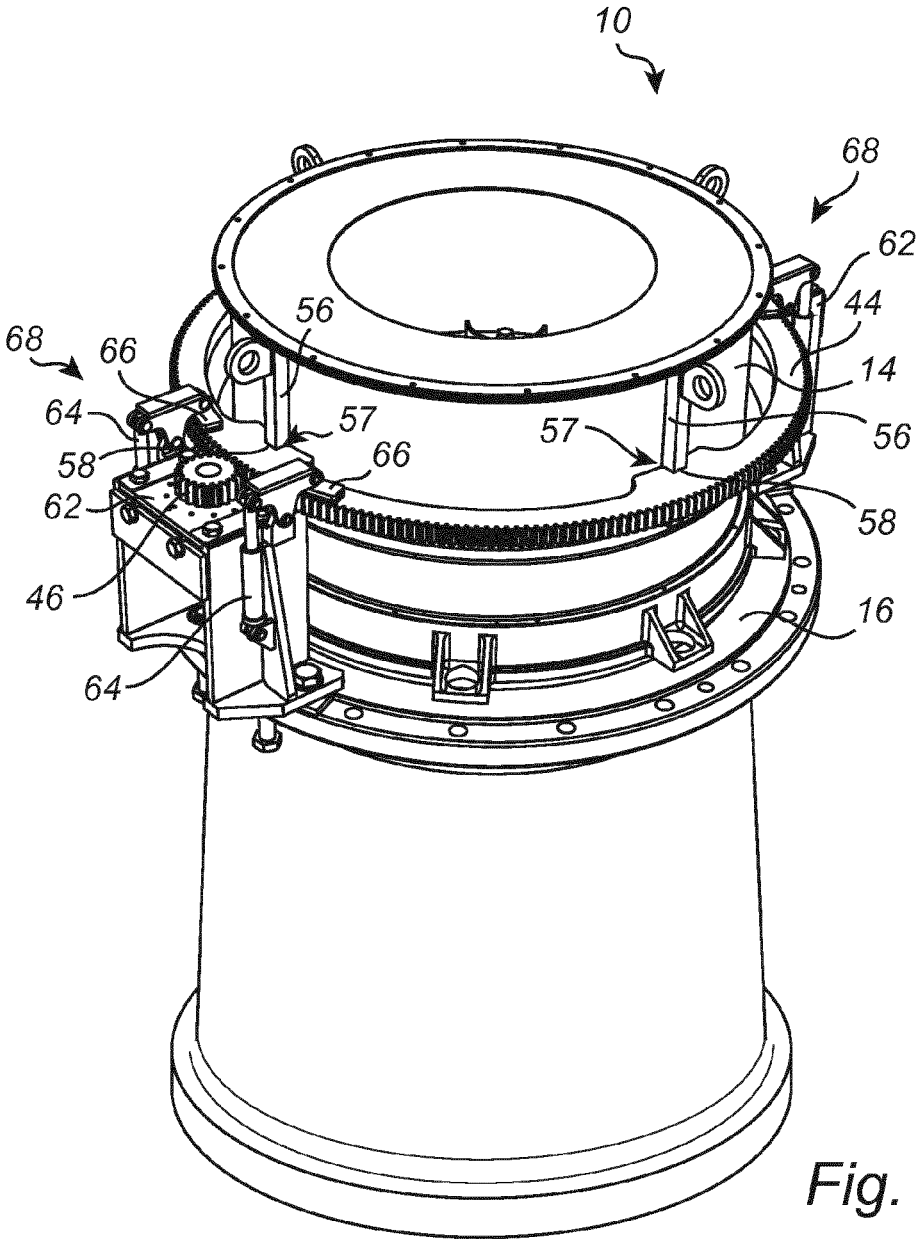
FIG. 2*a* is a schematic perspective view of the cone crusher of FIG. 1.

FIGS. 1 and 2*a* illustrate a cone crusher 10 of the inertia cone crusher type. The cone crusher 10 comprises a crusher frame 12 in which the various parts of the crusher 10 are mounted. The frame 12 is suspended on cushions 11 to dampen vibrations occurring during the crushing action.

The crusher frame 12 comprises an upper frame member 14, which has the shape of a bowl, and a lower frame member 16. The upper frame member 14 is provided with an outer thread 18, which co-operates with an inner thread 20 of the lower frame member 16 in such a manner that the inner and outer threads 20, 28 together form a threaded engagement 19.

The upper frame member 14 supports, on the inside thereof, an outer crushing shell 22. The lower frame member 16 supports an inner crushing shell arrangement 24. The inner crushing shell arrangement 24 comprises a crushing head 26, which has the shape of a cone and which supports an inner crushing shell 28. The outer and inner crushing shells 22, 28 form between them a crushing gap 30, to which material that is to be crushed is supplied.

The crushing head 26 rests on a spherical bearing 32, which is supported by the lower frame member 16. The crushing head 26 is rotatably connected to an unbalance bushing 34, which has the shape of a cylindrical sleeve. An unbalance weight 36 is mounted on one side of the unbalance bushing 34. At its lower end the unbalance bushing 34 is connected to a drive shaft 38 via a transmission shaft 40. Universal joints 42 of the transmission shaft 40 allow the lower end of the unbalance bushing 34 to be displaced from a vertical axis A during operation of the crusher.

When the crusher 10 is in operation, the drive shaft 38 is rotated by a motor in a non-illustrated manner, e.g. via a belt-and-pulley transmission 43. The rotation of the drive shaft 38 causes the unbalance bushing 34 to rotate, and as an effect of that rotation the unbalance bushing 34 swings outwards in response to the centrifugal force to which the unbalance weight 36 is exposed. The combined rotation and swinging of the unbalance bushing 34 makes the crushing head 26 gyrate about a vertical axis, such that material is crushed in the crushing gap 30 between the outer and inner crushing shells 22, 28.

The width of the crushing gap 30 can be adjusted by turning the upper frame member 14, by means of the threads 18, 20, such that the vertical distance between the shells 22, 28 is adjusted. To this end, the upper frame member 14 is provided with a circumferential gear ring 44. The gear ring 44 is in mesh with a pinion 46, which is arranged to be rotated by a crushing gap adjustment motor (not shown) mounted within a motor bracket 62 fitted to the lower frame member 16. By operating the crushing gap adjustment motor, the pinion 46 turns the gear ring 44, and thereby also the upper frame member 14, such that the upper frame member 14 is vertically translated by the threaded engagement 19. Thereby, also the outer crushing shell 22 is vertically translated, such that the width of the crushing gap 30 is adjusted.

Figure 2B:
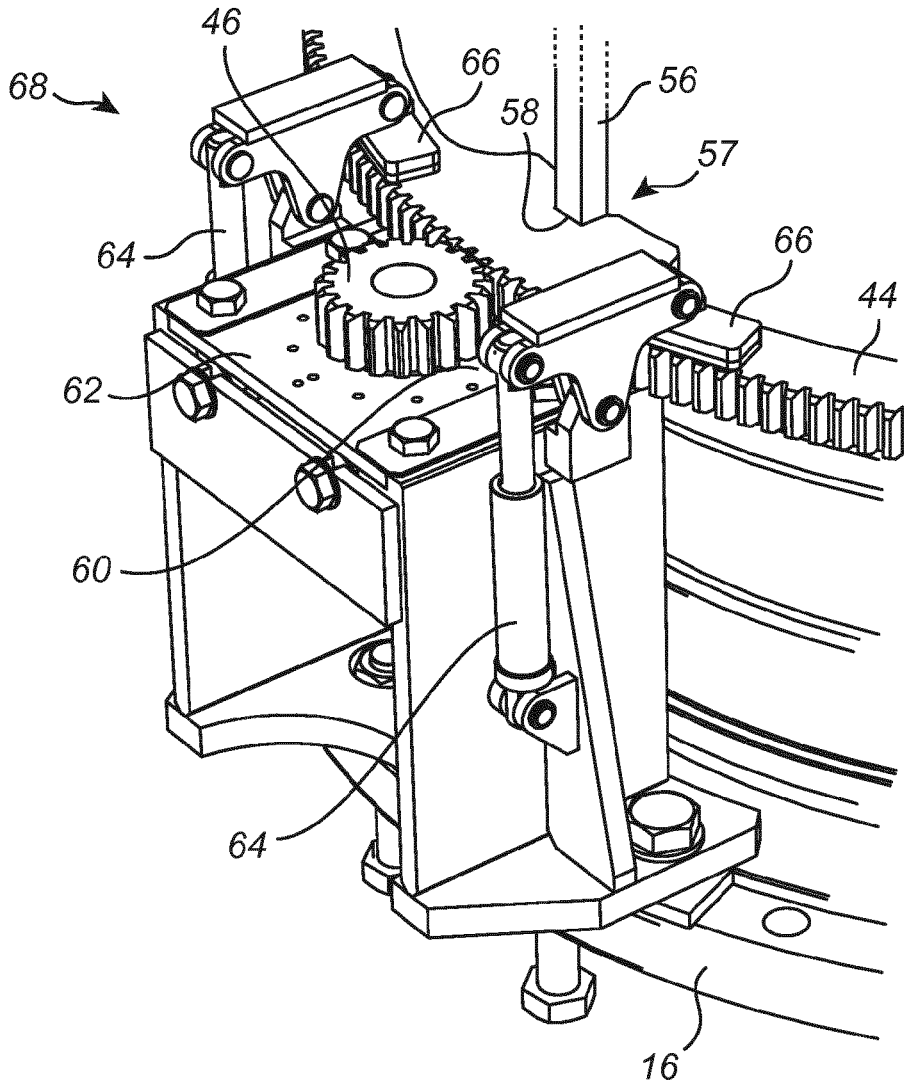
FIG. 2*b* is a magnified view of a gear ring clamping arrangement, illustrated in the perspective of FIG. 2*a*.
Figure 3B:
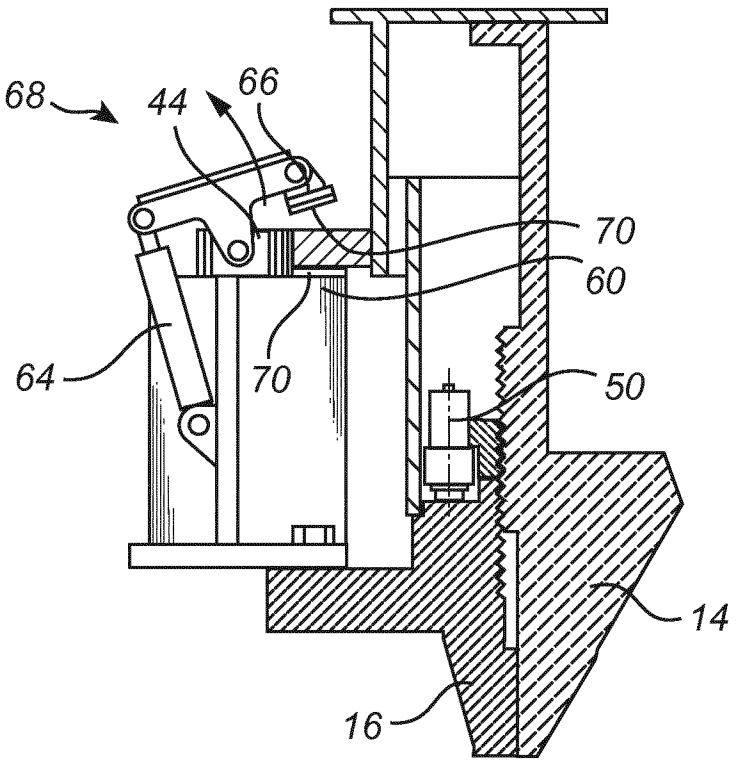
FIG. 3*b* is a schematic view, partly in section, of the gear ring clamping arrangement of FIG. 3*a*, the clamping arrangement being illustrated in a released state.
Figure 3A:
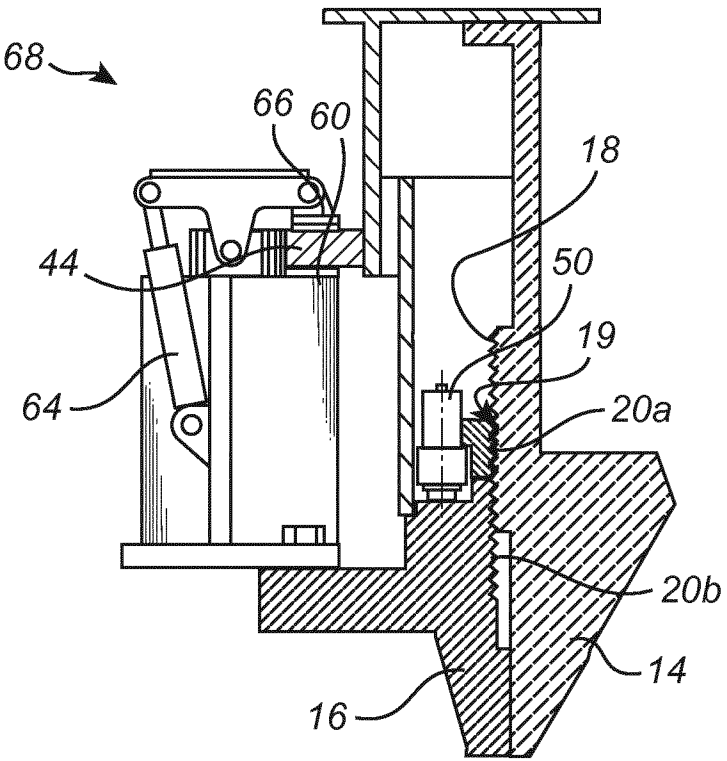
FIG. 3*a* is a schematic view, partly in section, of the gear ring clamping arrangement of FIG. 2*b*, the clamping arrangement being illustrated in a clamped state.

FIGS. 2*b* and 3*a-b* illustrate in greater detail an arrangement for adjusting the width of the crushing gap 30. The inner thread 20 of the lower frame member 16 is divided into an upper thread portion 20*a* and a lower thread portion 20*b*. A hydraulic thread clamping cylinder 50 is arranged to, upon actuation, press the two thread portions 20*a-b* apart, such that the threaded engagement 19 is clamped, and the upper frame member 14 (FIG. 1) is prevented from turning or vibrating relative to the lower frame member 16. Referring again to FIG. 1, a plurality of similar thread clamping cylinders 50 are arranged around the periphery of the crusher 10. The thread clamping cylinders are operated by a control system 52 via a hydraulic circuit 54. When the crushing gap 30 is to be adjusted, the hydraulic pressure of the thread clamping cylinders 50 is released, such that the upper frame member 14 is allowed to turn in the threaded engagement 19. Then, the crushing gap 30 is adjusted by operating the pinion 46 by means of the motor, such that the gear ring 44 turns the upper frame member 14 in the threaded engagement 19, thereby vertically translating the upper frame member 14.

After having adjusted the crushing gap 30, the crusher 10 is prepared for crushing by clamping the threaded engagement 19, by pressurizing the hydraulic circuit 54, such that the upper and lower frame members 14, 16 form one single, rigid unit.

Referring now to FIGS. 2*a-b*, the gear ring 44 is connected to the upper frame member 14 via a keyed sliding engagement 57, which allows the gear ring 44 to remain in engagement with the pinion 46 while the upper frame member 14 is vertically translated. The keyed sliding engagement 57 is formed by a vertical bar 56, attached to the upper frame member 14, which is keyed with a mating notch 58 of the inner periphery of the gear ring 44. Thereby, the gear ring 44 is rotationally locked to the upper frame member 14, and may slide vertically along the bar 56. The gear ring 44 rests, and when turned, slides upon a lower clamping member 60, which is formed by an upper portion of the motor support bracket 62. The lower clamping member 60, formed by the motor bracket 62, is flanked by a pair of hydraulic gear ring clamping cylinders 64, each of which is arranged to press an upper clamping member 66 against an upper surface of the gear ring 44. Together, the upper and lower clamping members 66, 60 form a clamping arrangement 68. The clamping arrangement 68 is configured to vertically clamp the gear ring 44 in a releasable manner, such that when clamped, the gear ring 44 is prevented from moving relative to the frame 12. Thereby, vibration-induced wear to the cogs of the gear ring 44 and the pinion 46, as well as to the keyed sliding engagement 57, is minimized. The gear ring clamping arrangement 68 is to be clamped when the crusher 10 is operated; when the width of the crushing gap 30 is to be adjusted, the clamping arrangement 68 is released, such that the gear ring 44 is allowed to translate vertically relative to the upper frame member 14. To this end, the gear ring clamping cylinders 64 of the gear ring clamping arrangement 68 are connected to the same hydraulic circuit 54 (FIG. 1) as the thread clamping cylinders 50. Thereby, the gear ring clamping cylinders 64 of the gear ring clamping arrangement 68 may be operated simultaneously with the thread clamping cylinders 50.

FIG. 3*a* illustrates the gear ring clamping arrangement 68 in a clamped state, in which the upper and lower clamping members 66, 60 vertically clamp the gear ring 44, whereas FIG. 3*b* illustrates the gear ring clamping arrangement 68 in a released state.

The upper and lower clamping members 66, 60 comprise clamping pads 70. The clamping pads 70 may be made of e.g. natural or synthetic rubber, such as polyurethane or the like, in order to obtain a more suitable friction between the clamping members 60, 66 and the gear ring 44. The increased friction reduces the amount of clamping force needed for holding the gear ring 44, and will in particular strengthen the engagement between the clamping members 60, 66 and the gear ring 44 in a direction perpendicular to the applied clamping force, such that the clamping arrangement 68 will more efficiently prevent the gear ring 44 from vibrating along the plane perpendicular to the axis A (FIG. 1).

In the released state of FIG. 3*b*, the gear ring 44 rests by its own weight upon the clamping pad 70 of the lower clamping member 60, and is free to turn relative to the gear ring clamping arrangement 68 about the vertical axis A, thereby turning also the upper frame member 14.

Returning to FIG. 2, the crusher 10 is provided with two similar motor support brackets 62, each fitted with a crushing gap adjustment motor and each forming, together with a flanking pair of upper clamping members 66, a clamping arrangement 68. As the gear ring 44 may typically weigh about 400 kg, and vibrations may expose the gear ring to accelerations of the order 2-4 g, the total clamping force applied to the gear ring 44 along its circumference preferably exceeds 8 kN, and even more preferred, exceeds 12 kN.

The invention has mainly been described above with reference to a few embodiments. However, as is readily appreciated by a person skilled in the art, other embodiments than the ones disclosed above are equally possible within the scope of the invention, as defined by the appended patent claims.

For example, the invention is not limited to any particular type of cone crusher; on the contrary, it is suited for many different types of cone crushers known to those skilled in the art, such as the type of crusher having the top of a head shaft journalled in a spider assembly, as well as the type of crusher that is described in U.S. Pat. No. 1,894,601, occasionally called Symons type, and the inertia type cone crushers disclosed herein, having an unbalance weight for obtaining a gyratory motion of the crushing head.

Clearly, the invention is not limited to a clamping arrangement 68 comprising a pair of upper clamping members 66; a single upper clamping member 66 will suffice for vertically clamping the gear ring 44 against the lower clamping member 60. And as has been illustrated in the foregoing, clamping members 60, 66 need not be located directly opposite each other on the respective upper and lower sides of the gear ring 44. However, embodiments comprising oppositely arranged upper and lower clamping members 66, 60 are also within the scope of the appended claims.

It is not necessary that the lower clamping member 60 be fixed and the upper clamping member 66 be arranged to be actuated; as an alternative, the lower clamping member 60 may be actuated, for clamping the gear ring 44 against a stationary upper clamping member 66. As still an alternative, both upper and lower clamping members 66, 60 may be arranged to be actuated.

It is further not necessary that a clamping arrangements 68 comprise a motor support bracket 62; a clamping arrangement may be provided separate from the motor support bracket 62, and may comprise a separate lower clamping member specifically configured for the purpose and having no other function than acting as a lower clamping member. Similarly, it is not necessary that upper and lower clamping members 66, 60 be fitted to the lower frame portion 16. As an alternative, one or both clamping members 60, 66 may be fitted to the upper frame portion 14.

Even though hydraulic gear ring clamping cylinders 64 have been described hereinbefore, also other types of power actuators may be used for operating clamping arrangement, such as electric motors, electromagnets or the like. In fact, a clamping arrangement may be manually operated, even though this is less preferred in view of the significant clamping forces typically needed.

The invention claimed is:

1. A cone crusher comprising:

an outer crushing shell and an inner crushing shell forming between them a crushing gap, the outer crushing shell being supported on an upper frame member in threaded engagement with a lower frame member, said threaded engagement being configured for adjusting the vertical position of the outer crushing shell relative to the lower frame member so as to permit adjustment of the width of the crushing gap, the upper frame member being provided with a circumferential gear ring for turning the upper frame member in said threaded engagement, the gear ring being connected to the upper frame member in a rotationally locked and vertically slidable manner; and a clamping arrangement for vertically clamping the gear ring between an upper clamping member and lower clamping member.

2. The cone crusher according to claim 1, wherein the clamping arrangement includes a power actuator for tightening the clamping arrangement, said power actuator being controlled by a control system of the crusher.

3. The cone crusher according to claim 2, wherein said power actuator is a hydraulic cylinder.

4. The cone crusher according to claim 3, wherein said hydraulic cylinder is connected to a hydraulic circuit configured to operate also a set of hydraulic cylinders for clamping the threaded engagement.

5. The cone crusher according to claim 1, wherein said upper and lower clamping members are fitted to the lower frame member.

6. The cone crusher according to claim 1, wherein the lower clamping member is fixed to the lower frame member, the upper clamping member being moveable relative to the lower frame member.

7. The cone crusher according to claim 1, wherein the lower clamping member is formed by a motor support bracket.

8. The cone crusher according to claim 1, wherein the clamping arrangement has a pair of upper clamping members flanking a lower clamping member along the circumference of the gear ring.

9. The cone crusher according to claim 1, wherein wherein at least one of said clamping members includes a clamping pad of synthetic or natural rubber.

10. A method of preparing a cone crusher for operation comprising the steps of:

adjusting a crushing gap between an outer crushing shell and an inner crushing shell; and followed by vertically clamping a crushing gap adjustment gear ring.

11. The method according to claim 10, further comprising the step of simultaneously clamping said crushing gap adjustment gear ring and a crushing gap adjustment thread.

12. The method according to claim 11, wherein said crushing gap adjustment gear ring and said crushing gap adjustment thread are simultaneously clamped by means of respective clamping arrangements, by operating a hydraulic circuit common to said clamping arrangements.

* * * * *